US005936179A

United States Patent [19]

Merrick et al.

[11] Patent Number: 5,936,179

[45] Date of Patent: Aug. 10, 1999

[54] APPARATUS INCLUDING VISUAL DISPLAY FOR TUNING STRINGED MUSICAL INSTRUMENTS

[75] Inventors: Jeffrey A. Merrick, 210 Wesley Ct., Roseville, Calif. 95661; Keith F. Elliston, Sacramento, Calif.

[73] Assignee: Jeffrey A. Merrick, Roseville, Calif.

[21] Appl. No.: 08/752,166

[22] Filed: Nov. 18, 1996

Related U.S. Application Data

[63] Continuation-in-part of application No. 08/503,825, Jul. 18, 1995, abandoned, and application No. 08/635,618, Apr. 22, 1996.

[51] Int. Cl.[6] ..... G10G 7/02

[52] U.S. Cl. ..... 84/454; 84/455; 84/477 R; 84/DIG. 18

[58] Field of Search ..... 84/454, 455, 477 R, 84/DIG. 18

[56] References Cited

U.S. PATENT DOCUMENTS

| | | | |
|---|---|---|---|
| 5,029,511 | 7/1991 | Rosendahl | 84/743 |
| 5,388,496 | 2/1995 | Miller et al. | 84/454 |
| 5,637,820 | 6/1997 | Wittman | 84/454 |

*Primary Examiner*—David Martin
*Assistant Examiner*—Marlon T. Fletcher
*Attorney, Agent, or Firm*—Thomas R. Lampe

[57] ABSTRACT

Apparatus for tuning a stringed musical instrument includes an electronic tuner circuit and a visual display located in either the pickguard or the pickup mounting ring of the instrument.

5 Claims, 5 Drawing Sheets

APPARATUS INCLUDING VISUAL DISPLAY FOR TUNING STRINGED MUSICAL INSTRUMENTS

This application is a continuation-in-part of copending U.S. patent application Ser. No. 08/503,825, filed Jul. 18, 1995, abandoned, and of U.S. patent application Ser. No. 08/635,618, filed Apr. 22, 1996.

TECHNICAL FIELD

This invention relates to apparatus for a tuning a stringed musical instrument. More specifically, the apparatus incorporates a visual display observable by the user of the stringed instrument to assist in the tuning thereof.

BACKGROUND OF THE INVENTION

It is well known amongst guitar players that keeping one's guitar in tune is a constant and ongoing problem. Before the days of electronic tuners, all tuning had to be done by ear. Accordingly, those persons having a better ear for musical tones were better able to tune their guitars. Those persons not having such an ear had a more difficult time. Modern day electronic tuners have taken the human ear factor out of tuning one's guitar. Many different types of external electronic tuners are currently available.

Although many types of external tuners are available, these external units must be attached to one's instrument via an electronic cable. Hooking up these types of tuners becomes a chore that can be eliminated by utilizing a tuner that is built into the instrument itself.

In considering a built in tuner for an instrument such as a guitar, functionality as well as aesthetics must be taken into account. It is indeed most desirable to preserve the original beauty of the instrument while maximizing the usefulness of the tuner itself.

Other built in tuners have attempted to solve this problem-for example, U.S. Pat. No. 4,018,124, issued Apr. 19, 1979 discloses a built in tuner in which the guitar must be manufactured to accommodate the tuner. This approach could not be used on pre-existing guitars. As well, the tuning indicators were large and took away from the beauty of the instrument. Another approach is the Sabine Stealth tuner made available by Sabine, Inc., Gainesville, Fla. The Sabine tuner is a built in tuner module with a remote L.E.D. tuning indicator which can be mounted on the guitar. When installing the Sabine tuner, some customizing of the guitar must be done, i.e. routing, drilling, etc., which can detract from the value of the guitar. In addition, the remote L.E.D. tuning indicator is highly obtrusive to the appearance of the guitar. It must be glued or otherwise attached to the front of the guitar, leaving the L.E.D. housing in plain view for all to see. Furthermore, installation of the Sabine tuner requires considerable skill and ingenuity to obtain a desirable result.

DISCLOSURE OF INVENTION

Accordingly, several objects and advantages of the present invention are:

(a) to provide a tuner which has the convenience of being built into the instrument. This type of built in tuner requires no external units or cords;

(b) to provide a built in tuner that can be easily incorporated into the construction of a new guitar;

(c) to provide a built in tuner which can be easily installed into an existing instrument without any modification of the instrument such as drilling or routing. In the preferred embodiment of a pickguard, the user simply replaces the old pickguard with the new pickguard which as the tuner visual display built in. Such a replacement process can be easily accomplished by a lay person possessing no special skills; and (d) to provide a built in tuner that will not detract from the natural beauty of the instrument.

Further objects and advantages are to provide a built in tuner with a visual L.E.D. read-out to indicate the tuning functions. In an embodiment disclosed herein, light from such an L.E.D. read-out can be transmitted to a substantially thin or small, remote location with the use of fiber optics. With such a thin or small remote location with the use of fiber optics. With such a thin or small remote location, the visual read out can be made substantially inconspicuous, thereby having a minimum impact on the aesthetic beauty of the instrument.

BRIEF DESCRIPTION OF DRAWINGS

For purposes of illustrating the invention, there are shown in the accompanying drawings forms which are presently preferred, it being understood that the invention is not intended to be limited to the precise arrangements or instrumentalities shown.

BEST MODE FOR CARRYING OUT THE INVENTION

A typical embodiment of the present invention is illustrated in FIGS. 1 through 4B.

Figures 1, 1A:
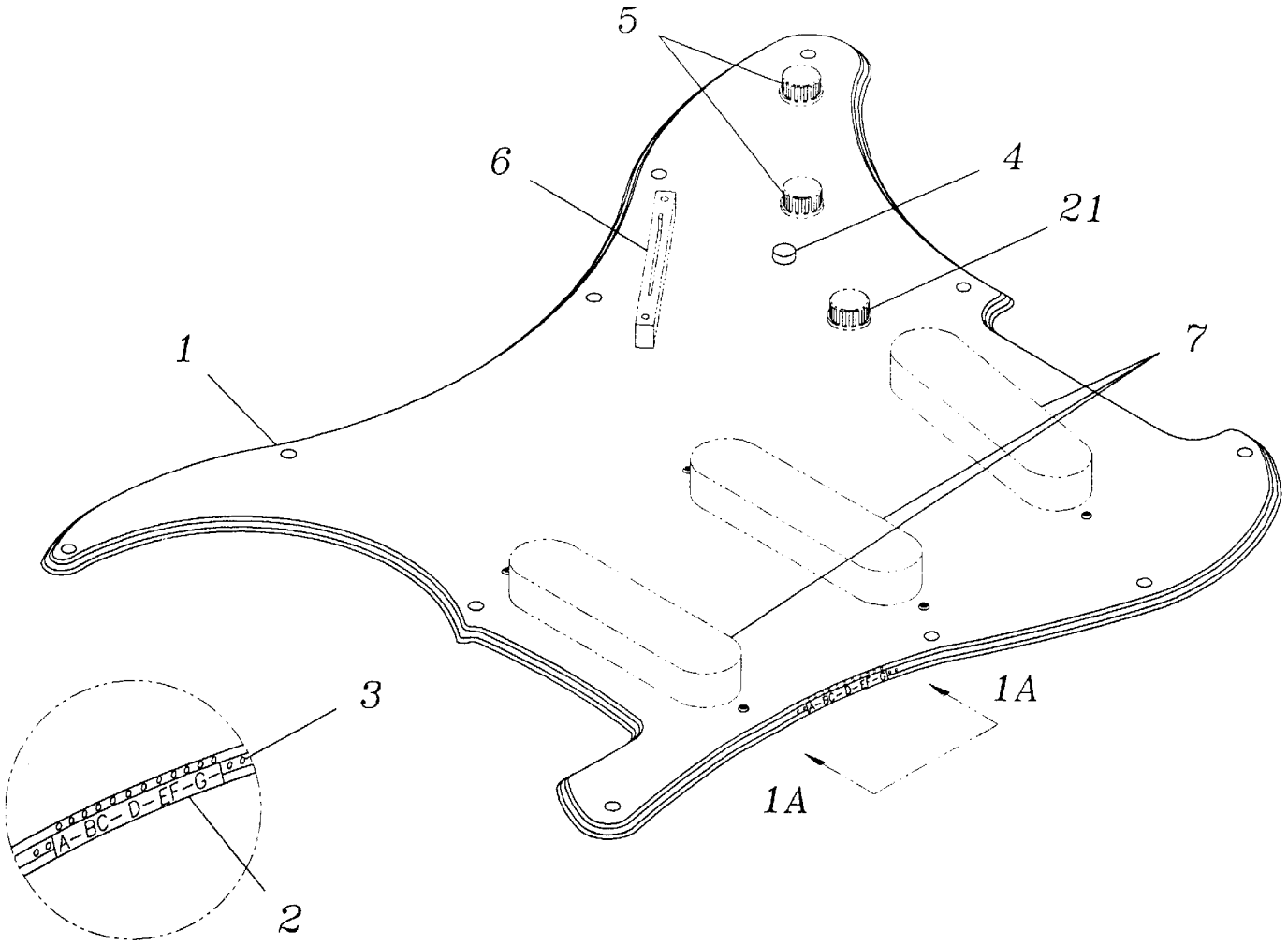
FIG. 1 is a frontal perspective view of a guitar pickguard constructed in accordance with the teachings of the present invention.
Figure 2:
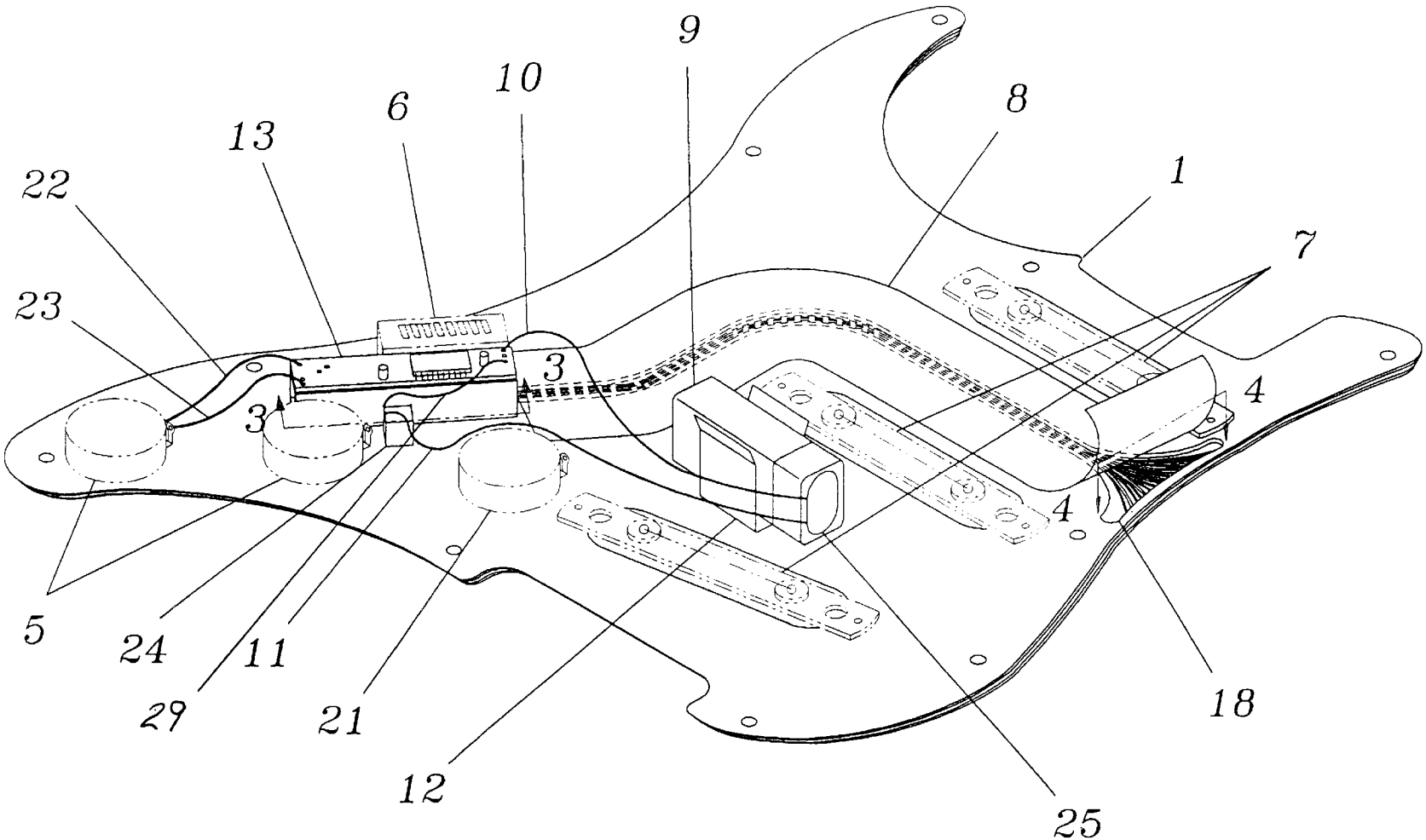
FIG. 2 is a rear perspective view of the back side of a guitar pickguard constructed in accordance with the teachings of the present invention.

Referring now to the drawings in detail, wherein like reference characters indicate like parts throughout the several figures, FIG. 1 (front view) and FIG. 2 (back view) illustrate a pickguard constructed in accordance with the invention.

A pickguard 1 is of conventional structure and is originally designed to hold the various electronic components of an electric guitar. These components include a plurality of pickups 7, two tone controls 5, a volume control 21, and a pickup selector switch 6.

Figure 4:
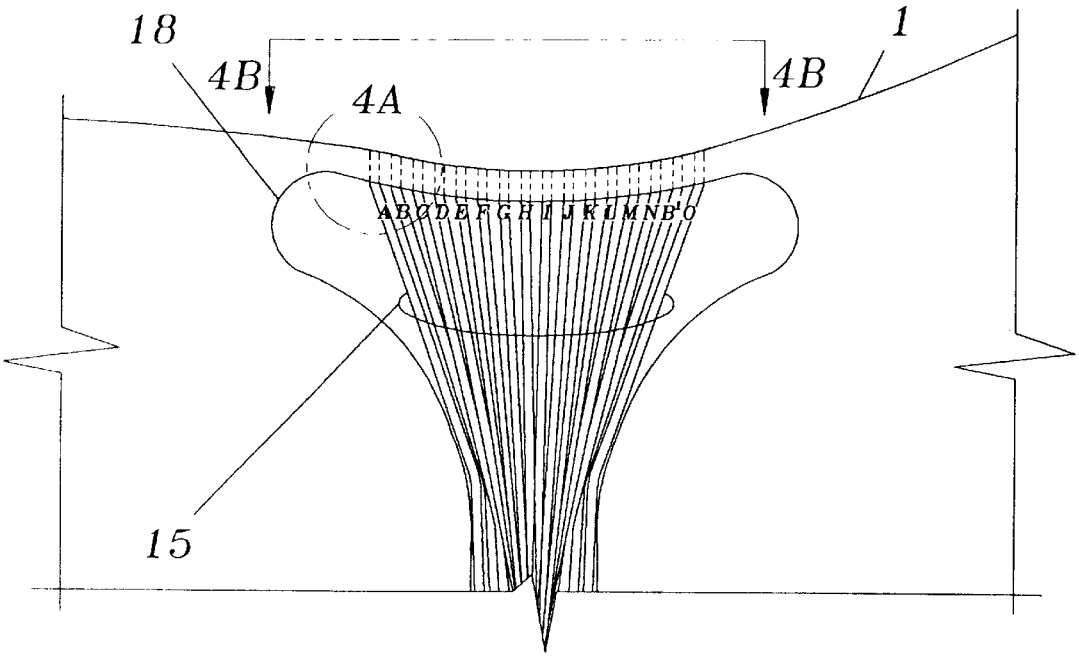
FIG. 4 is an enlarged view of the channel which holds the fiber optic strands on the back side of the pickguard, this view illustrating how the channel flanges out near the edge of the pickguard allow the fibers to spread out before entering the holes and then terminating in the front edge.

A fiber optic channel 18 is routed into the back side of pickguard 1. Said channel is roughly a depth of 1/32" and does not extend through to the front of the pickguard. The channel 18 begins near tuner circuit 13 and terminates near the top edge of pickguard 1. At the termination point of said channel, the width is increased to roughly 2 inches in a flanging manner (FIG. 4). The termination of said channel is roughly 1/16" from the edge of pickguard 1.

Figure 4A:
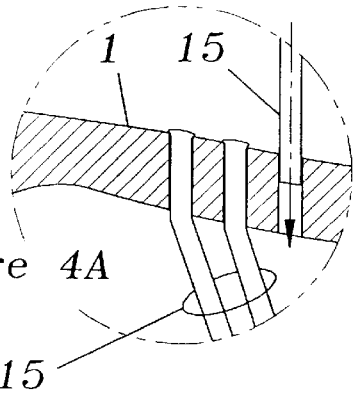
FIG. 4A is an enlarged view of three of the strands in FIG. 4, one strand being inserted into one of the holes in the front edge of the pickguard and the other two strands already having been pulled through the holes, leaving just the tips to reside in the front edge of the pickguard.
Figure 4B:
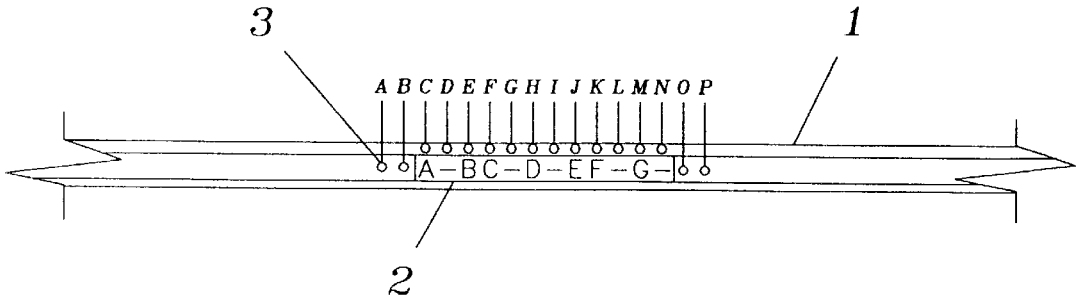
FIG. 4B is an enlarged view of the front edge of the pickguard showing the holes drilled therein and also showing a decal that assigns a musical note to twelve of these holes which will house the ends of the fiber optic strands.

Holes 3 C–N are drilled through the upper front edge of pickguard 1 substantially an equal distance apart (FIG. 4B). Holes 3A, 3B, 30 and 3P are drilled in the middle front edge 2 of pickguard 1 with holes 30 and 3P to the right of holes 3C–3N. All of said holes exit through the back side of pickguard 1 at the flanged portion of channel 18 (FIG.4).

Fiber optic strands 15 A–P with a diameter just slightly smaller than holes 3 A–P are cut to a predetermined length. Said length of strands will be long enough to travel from the top edge of pickguard 1 through channel 18 with roughly two inches extending beyond the end of channel 18. The purpose of this extra length will become evident hereafter.

Strands 15 A–P are slightly "bulbed" on one end by heating the ends with a heat source (not shown) (FIG. 4A).

The ends of the strands 15 A–P which are not "bulbed" are inserted into holes 3 A–P and are pulled through from the back side of pickguard 1 leaving only the bulbed tips to reside in the edge of the pickguard (FIG. 4A).

A liquid contact type adhesive is applied to the surface of channel 18. Said adhesive will hold the strands 15 A–P in place as described in the next paragraph.

The strands 15 A–P are pulled tight from the back side of pickguard 1. The "bulbs" on the ends of said strands will keep the strands from pulling all the way through holes 3 A–P. As said strands are pulled tight, they are kept in their same relative positions and laid flat, side by side, into channel 18. A protective tape 8 is applied over channel 18 and strands 15A–15. (FIG. 2).

Figure 3A:
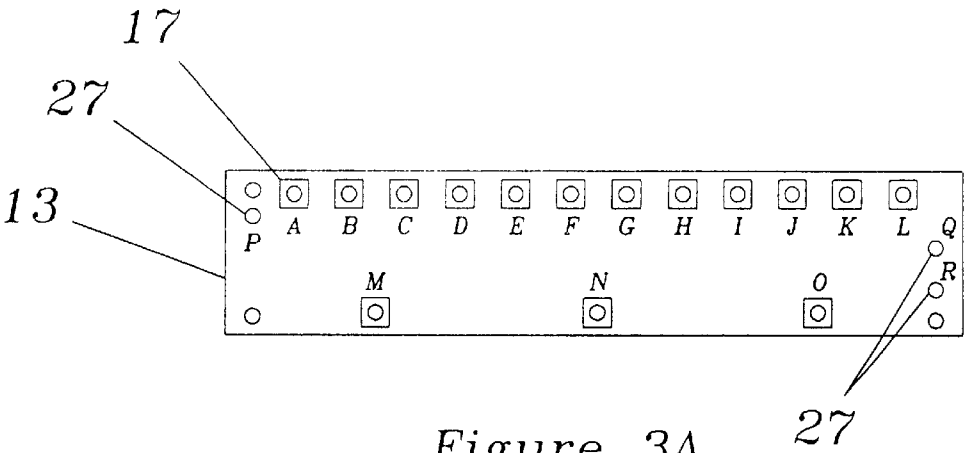
FIG. 3A is the bottom view of the tuner circuit showing a plurality of L.E.D.'s and holes.
Figure 3B:
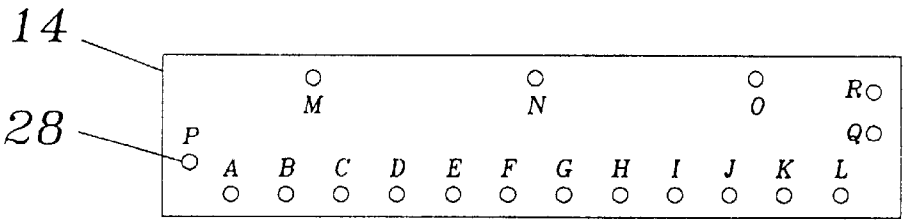
FIG. 3B is a enlarged view of the alignment plate 14 showing a plurality of holes.

An alignment plate 14 is made from a thin circuit board material and is of the same length and width as tuner circuit 13. Holes 28A–280 of a size slightly larger than the diameter of strands 15A–15P are drilled through the plate. Hole 28N of a diameter roughly twice the diameter of holes 28A–28L is drilled in plate 14. Hole 22N is larger than all of the other holes because it will accept two strands whereas the remaining holes will accept only one strands. Holes 28A–280 on plate 14 correspond and align with L.E.D.s 17A–170 on tuning circuit 13 (FIGS. 3A and 3B).

The non "bulbed" ends of strands 15A–150 which extend from the end of routed channel 18 are inserted into holes 28A–280 in the bottom of plate 14 as follows (FIG. 3): The end of strand 15A is inserted into hole 28M on the bottom side if plate 14 and said strand is pulled through the top of said plate. In a like manner, strand 15B is inserted into hole 28N, strand 15C is inserted into hole 28A, strand 15D is inserted into hole 28B, strand 15E is inserted into hole 22C, strand 15F is inserted into hole 28D, strand 15G is inserted into hole 28E, strand 15H is inserted into hole 28F, strand 15I is inserted into hole 28G, strand 15J is inserted into hole 28H, strand 15K is inserted into hole 28I, strand 15L is inserted into hole 28J, strand 15M is inserted into hole 28K, strand 15N is inserted into hole 28L, strand 150 is inserted into hole 28N, and strand 15P is inserted into hole 280.

Figure 3:
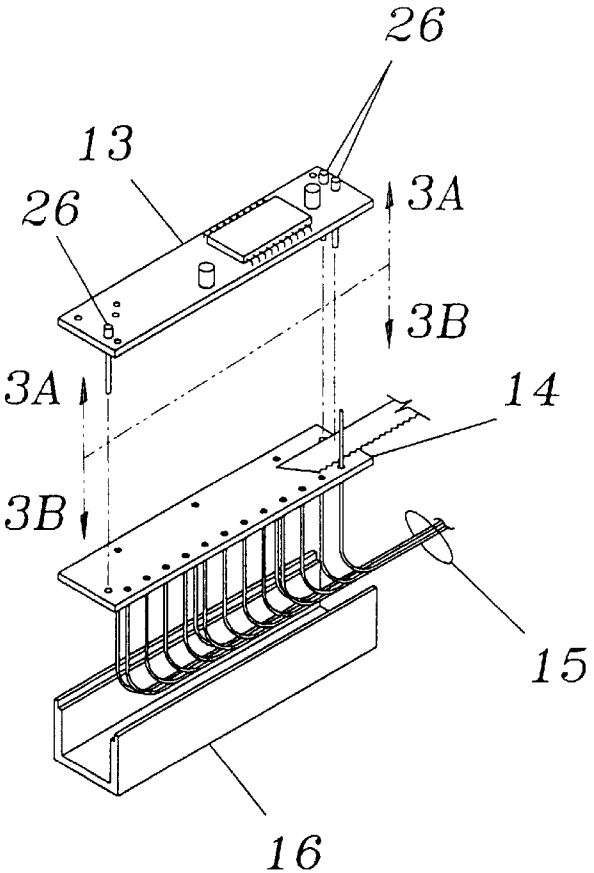
FIG. 3 is an exploded view of a tuner circuit, alignment plate, base, and fiber optic strands showing the assembly of these parts.

A base 16 is a thin walled, "U" shaped, clear plastic object of the same length and width as plate 14 (FIG.3). The height of the base 16 is roughly ½ inch. The base 16 is mounted on top of the pickguard 1 with an adhesive and positioned such that one end is aligned with the end of the channel 18 (FIG. 2). Base 16 is also positioned with its linear center axis in line with the linear center line of channel 18 (FIG. 2).

The plate 14 is lowered onto the housing 16 with the excess slack of the strands 15A–15P pulled through the top of the plate 14 (FIG. 3). The plate 14 is now attached to the base 16 with an adhesive such as cyanoacrylate ("Super Glue"). The base 16 is provided to act as a support structure for the plate 14 and tuner circuit 13. Said base is also provided to act as a protective container to guard against damage to exposed strands 15A–15P where said strands exit said channel and enter said plate. The clear nature of said base allows one to see said strands as they are being pulled through the plate 14. Being able to see said strands allows one to avoid pulling the strands too tight so as not to cause damage to the strands by kinking them.

The excess of the strands protruding from the top of the plate 14 is now cut flush with said plate using a heated razor knife (FIG. 3). Said knife will slightly "bulb" the ends of strands 15A–15P as it cuts them, thereby keeping the strands from slipping back through the holes in plate 14.

FIG. 3 shows three alignment pins 26 on the bottom side of circuity 14. Alignment pins 26 correspond to holes 28P–28R on plate 14 (FIG. 3B).

FIG. 3A is the underneath view of a tuner circuit 13. Mounted on said circuit is a plurality of L.E.D. indicators. Each L.E.D. has a specific function relating to the operation of the tuning circuit. L.E.D. 17A corresponds to the musical note A. L.E.D. 17B corresponds to the musical note A sharp. L.E.D. 17C corresponds to the musical note B. L.E.D. 17D corresponds to musical note C. L.E.D. 17E corresponds to musical note C sharp. L.E.D. 17F corresponds to musical note D. L.E.D. 17G corresponds to musical note D sharp. L.E.D. 17H corresponds to musical note E. L.E.D. 17I corresponds to musical note F. L.E.D. 17J corresponds to musical note F sharp. L.E.D. 17K corresponds to musical note G. L.E.D. 17L corresponds to musical note G sharp.

L.E.D.s 17M–170 on circuit 14 are tuning indicator L.E.D.s. L.E.D. 17M corresponds to a "flat" note. L.E.D. 17N corresponds to a "in tune" note. L.E.D. 170 corresponds to a "sharp note".

Tuner circuit 13 is lowered and mounted onto plate 14 using an adhesive such as hot glue. The alignment pins 26 on circuit 13 protrude through the holes 28P–28Q on the top side of plate 14 assuring proper alignment of L.E.D.s 17A–170 with the tips of the ends of strands 15A–15P (FIG. 3).

Referring to FIG. 2, wires 22 and 23 protrude from the top side of circuit 13. Said wires are provided for hook-up to the output of an electric guitar in which the invention is to be installed.

Referring to FIG. 2, a 9 volt battery clip 25 is provided for positioning on a 9 volt battery 9. The positive lead 10 from said clip is soldered directly to the tuner circuit 13. The negative lead 11 of said clip is soldered to one terminal of a switch 24. A wire 29 is soldered at one end thereof to the other terminal of switch 24, and the other end of said wire is soldered directly to the circuit 13. The purpose of the wiring described herein is to provide an on-off mechanism for the circuit 13 utilizing the switch 24.

FIG. 1A shows an enlarged view of the front edge of the pickguard 1 constructed in accordance with the present invention. The black dots seen at the edge of said pickguard are tips of the ends of the strands 15A–15P.

A vinyl decal 2 is applied to the edge of the pickguard 1 in such a fashion as to align the letters and characters of said decal with the tips of strand ends 15C–15N. Said decal acts to indicate the significance of each tip.

With proper assembly of all parts before mentioned, the following will occur: Referring now to FIGS. 1–3, the tip of strand end 15A resides in the edge of pickguard 1. By virtue of its location, said end signifies a flat note. Said strand will terminate at the opposite end directly beneath L.E.D. 17 M on tuner circuit 13. Plate 14 assures proper alignment of this and all other strand ends with the corresponding L.E.D. on circuit 13 as described previously. In a like manner, strand end tip 15B signifying an in tune note will terminate at the opposite end directly beneath L.E.D. 17N on circuit 13. The tips of strand ends 15C–15N indicating the various notes in the musical scale will terminate at their opposite ends directly beneath the corresponding L.E.D.s on circuit 13. The end of strand 150 terminates at the opposite end directly beneath L.E.D. 17N along with strand 15B. The end of strand 15P terminates at the opposite end directly beneath L.E.D. 170. Two in tune strands are positioned beneath L.E.D. 17N. The purpose of having two strands beneath this one L.E.D. is to provide symmetry at the opposite end where said strands terminate at the front edge of pickguard 1.

The light being emitted from L.E.D.s 17A–170 on circuit 13 is transmitted through strands 15A–15P. Such transmission occurs because the tip of one end of each of strands 6A–6P terminates directly below the corresponding L.E.D. on circuit 13. The termination location of the ends of strands 15A–15P is made possible by the usage of alignment plate 14. The light being emitted by the various L.E.D.s on circuit 13 will be visually apparent at the opposite end of strands 15A–15P which reside in the edge of pickguard 1.

Figure 5A:
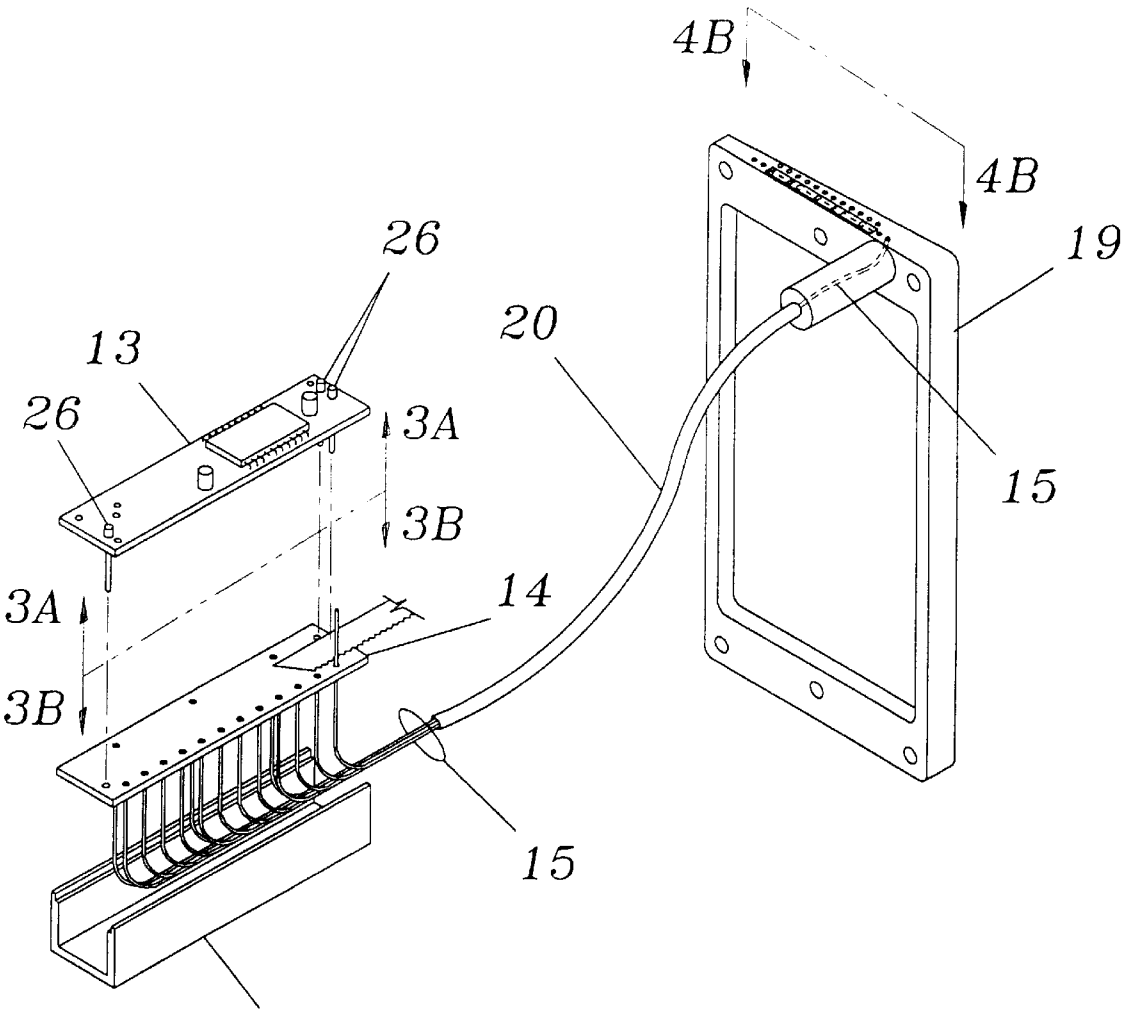
FIG. 5A is a rear view of the back side of the mounting ring showing the connection of the fiber optic strands to the tuner circuit assembly.
Figure 5:
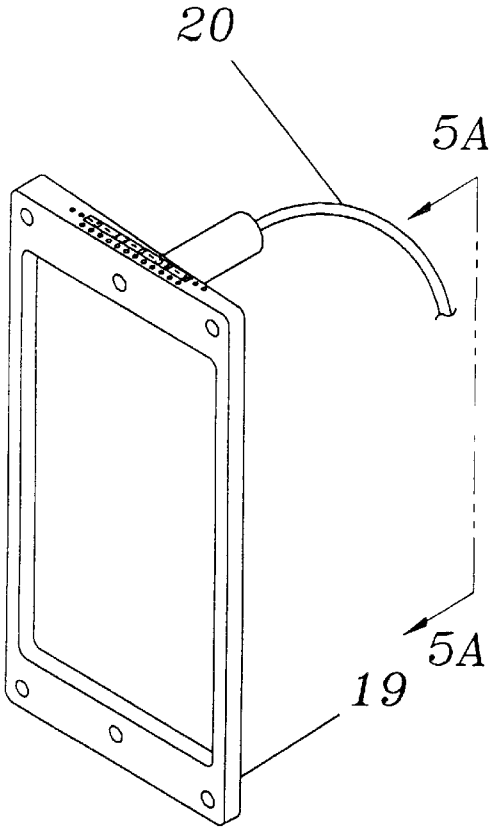
FIG. 5 is a perspective view of another embodiment of the present invention which uses a guitar pickup mounting ring to house the fiber optic display rather than a pickguard.

FIG. 5 shows another embodiment of the present invention. A guitar pickup mounting ring 19 is of conventional size and shape and is originally designed to hold a guitar pickup. The top edge of ring 19 has holes 3A–3P drilled into it (FIG. 4B). Strands 15A–150 are threaded through said holes. A casing 20 holds said strands together in a cable type arrangement. At the opposite end, said strands are connected to plate 14 as indicated in FIG. 5A. The operation of this embodiment is the same as previously described with regard to the pickguard embodiment. The difference in the alternative embodiment is that the fiber optic end tips reside in the edge of pickup ring 19 rather than in the edge of pickguard 1.

To utilize the first described (pickguard) embodiment of the present invention, one must first mount the usual electronics associated with an electric guitar on pickguard 1. These electronics include a plurality of pickups 7, a pickup selector switch 6, a volume potentiometer 21, and a pair of tone potentiometers 5.

After mounting said electronics on pickguard 1, input wires 22 and 23 are connected to the output of said electronics. This connection provides for an audio signal from the guitar's output to be fed to the input of the tuning circuit 13.

A 9 volt battery 9 is now connected to battery clip 25, providing power to the circuit 13.

The pickguard 1 can now be installed on a subject electric guitar. When said pickguard is installed on an electric guitar, the tuning apparatus will function as follows: The tuning circuit 13 is activated using switch 24. A string from the guitar is sounded which the user wishes to tune. The tuning circuit 13 senses which note is closest to the one being sounded and the corresponding L.E.D. is lit on said circuit. Simultaneously, one of the tuning indicator L.E.D.s in circuit 13 will light in the following manner: If the note being played is sharp, L.E.D. 170 will light in a on-off blinking manner; the more sharp the note being played is, the faster the rate of blinking, the closer the note is to being in tune, the slow the rate of blinking. In a similar manner, if the note being played is flat, L.E.D. 17M will light. The light from the L.E.D.s mentioned herein is transmitted through the corresponding fiber optic strands 15A–15P and will be visually apparent by observing the strand end tips located in the top edge of said pickguard.

After one determines if a note is flat or sharp by observing strand end tips 15A or 15P, one will adjust the tuning of the instrument so as to bring the note in tune. When the tuning circuit senses that the note being played is in tune, L.E.D. 17N and hence strand end tips 15B and 150 will light.

In a similar manner as before mentioned, all of the strings of the instrument can be tuned.

To utilize the alternate embodiment of a guitar pickup mounting ring, one replaces the existing ring with the guitar pickup mounting ring which contains the fiber optics and associated components (FIG. 5). The upper edge of said ring is visible to the user. The tuner circuit assembly shown in FIG. 5A can be placed in any number of cavities available on an electric guitar. The operation of said circuit is identical to the preferred embodiment of a pickguard previously described.

Thus, it will be seen that the tuner of the invention offers a convenient, inconspicuous, aesthetically pleasing device that can be installed on one's guitar. Installation of the invention requires only the replacement of one's pickguard or pickup ring.

Although the description above contains many specificities, these should not be construed as limiting the scope of the invention but as merely providing illustrations of some of the presently preferred embodiments of this invention. For example, the invention can be used on other instruments besides guitars such as banjos, violins, etc.

The composition and functionality of the tuning circuit need not be as described herein. As stated above, such tuning circuits per se are well known in the art.

We claim:

1. A tuning device of unitary construction for mounting on an electric guitar and for tuning the electric guitar, said tuning device comprising, in combination:

a pickguard having an outer peripheral wall, a bottom surface and a top surface;

electronic tuner circuit means attached to said pickguard at a first location on said pickguard and positioned on an electric guitar with said pickguard when said pickguard is connected to the electric guitar for sensing the frequency of vibrating strings of the electric guitar; and visual display means operatively connected to the electronic tuner circuit means by connector means, said visual display means attached to said pickguard at a second location spaced from the first location, and said visual display means providing a visual display responsive to the frequency of the vibrating strings sensed by the electronic tuner circuit means observable by a user of the electric guitar at said second location, said visual display means including a plurality of lights spaced from one another and attached to the pickquard, and said connector means located under the bottom surface of said pickguard.

2. The tuning device according to claim 1 wherein the plurality of lights are disposed at the outer peripheral wall of the pickguard.

3. The tuning device according to claim 1 wherein said visual display means and said electronic tuner circuit means are connected by fiber optic strands comprising said connector means, said plurality of lights comprising terminal ends of said fiber optic strands.

4. The tuning device according to claim 1 additionally comprising switch means for selectively activating and deactivating said electronic tuner circuit means.

5. The tuning device according to claim 2 wherein said pickguard outer peripheral wall defines a plurality of openings, and wherein each light of said plurality of lights is observable through an opening defined by said pickguard outer peripheral wall.

* * * * *